US005336138A

United States Patent [19]

Arjawat

[11] Patent Number: 5,336,138

[45] Date of Patent: Aug. 9, 1994

[54] HEAD, NECK, AND SHOULDER EXERCISE MACHINE

[76] Inventor: P. Singh Arjawat, 12101 Stoney Creek Rd., Potomac, Md. 20854

[21] Appl. No.: 2,332

[22] Filed: Jan. 7, 1993

[51] Int. Cl.[5] ..... A63B 23/025

[52] U.S. Cl. ..... 482/10; 482/123; 482/130; 482/136

[58] Field of Search ..... 482/10, 117, 100, 123, 482/128, 129, 130, 133, 134, 135, 136, 138, 148, 908; 297/114, 393, 396, 405, 406, 404, 411; 128/25 R; 602/17, 18

[56] References Cited

U.S. PATENT DOCUMENTS

| | | | |
|---|---|---|---|
| 1,008,456 | 11/1911 | Etter | 297/405 |
| 1,821,560 | 9/1931 | May | 297/405 |
| 2,949,298 | 8/1960 | Speelman . | |
| 3,428,311 | 2/1969 | Mitchell | 482/130 |
| 3,615,092 | 10/1971 | Stubbmann . | |
| 4,066,259 | 1/1978 | Brentham . | |
| 4,111,415 | 9/1978 | Reitano . | |
| 4,199,137 | 4/1980 | Giuére | 482/117 |
| 4,219,193 | 8/1980 | Newman | 602/17 |
| 4,250,874 | 2/1981 | Rude | 482/10 |
| 4,278,249 | 7/1981 | Forrest . | |
| 4,484,741 | 11/1984 | Bingisser . | |
| 4,537,393 | 8/1985 | Kusch . | |
| 4,583,731 | 4/1986 | Crivello et al. . | |
| 4,655,450 | 4/1987 | Rogers, Jr. et al. . | |
| 4,702,108 | 10/1987 | Amundsen | 482/138 |
| 4,720,100 | 1/1988 | Du Buy . | |
| 4,733,859 | 3/1988 | Kock et al. | 482/79 |
| 4,765,615 | 8/1988 | Case | 482/908 |
| 4,768,779 | 9/1988 | Oehman, Jr. et al. . | |
| 4,805,899 | 2/1989 | Roehlk . | |
| 4,822,028 | 4/1989 | McLellan et al. . | |
| 4,846,527 | 7/1989 | Julien et al. | 297/411 |
| 4,893,808 | 1/1990 | McIntyre et al. . | |
| 4,989,859 | 2/1991 | Jones . | |
| 5,009,467 | 4/1991 | McCoy | 297/411 |
| 5,176,601 | 1/1993 | Reynolds | 482/130 |

FOREIGN PATENT DOCUMENTS

| | | | |
|---|---|---|---|
| 0022002 | 1/1981 | European Pat. Off. | 482/148 |
| 2524329 | 10/1983 | France | 482/130 |
| 0757167 | 8/1980 | U.S.S.R. | 482/133 |
| 1289516 | 2/1987 | U.S.S.R. | 482/130 |
| 1303395 | 1/1973 | United Kingdom | 482/130 |

OTHER PUBLICATIONS

Athletic Journal, "The Total Neck Developer", May 1979, p. 43.

Nautilus Instruction Manual, Jun. 14, 1979, pp. 34–37.

*Primary Examiner*—Richard J. Apley
*Assistant Examiner*—Jeanne M. Mollo
*Attorney, Agent, or Firm*—Oblon, Spivak, McClelland, Maier & Neustadt

[57] ABSTRACT

An improved head, neck and shoulder apparatus is provided which can be utilized for exercise and/or therapy of the cervical spine and/or muscles associated with the cervical spine. The machine includes a head frame which receives a person's head, and a main frame which can receive a person in a seated position. A ball joint is provided for allowing relative movement of the head frame with respect to the main frame, with the ball joint positionable such that it can be located adjacent a desired location along the person's cervical spine, preferably at the cervico thoracic junction. Various aspects of the invention are also applicable to exercise machines designed for conditioning other muscles and/or muscle groups.

21 Claims, 9 Drawing Sheets

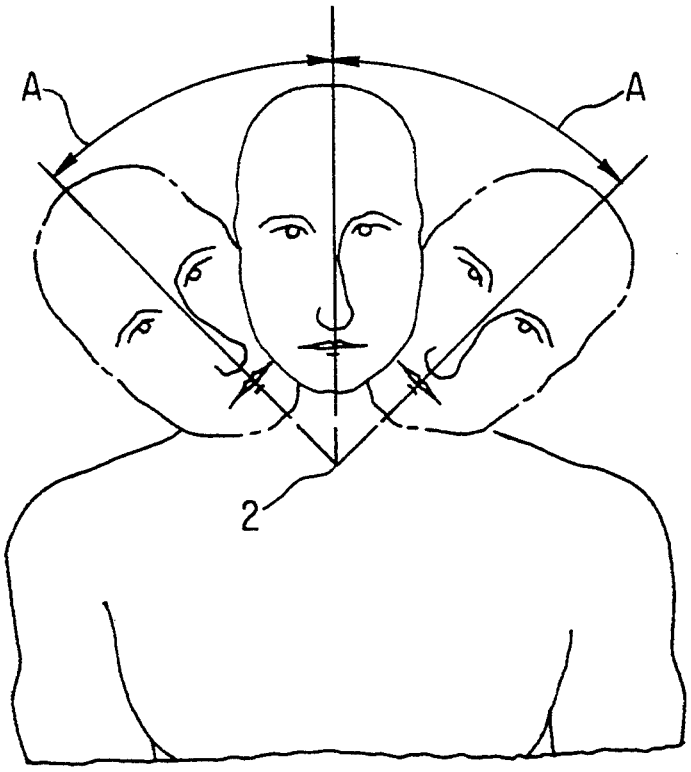
FIG. 1A
FIG. 1B
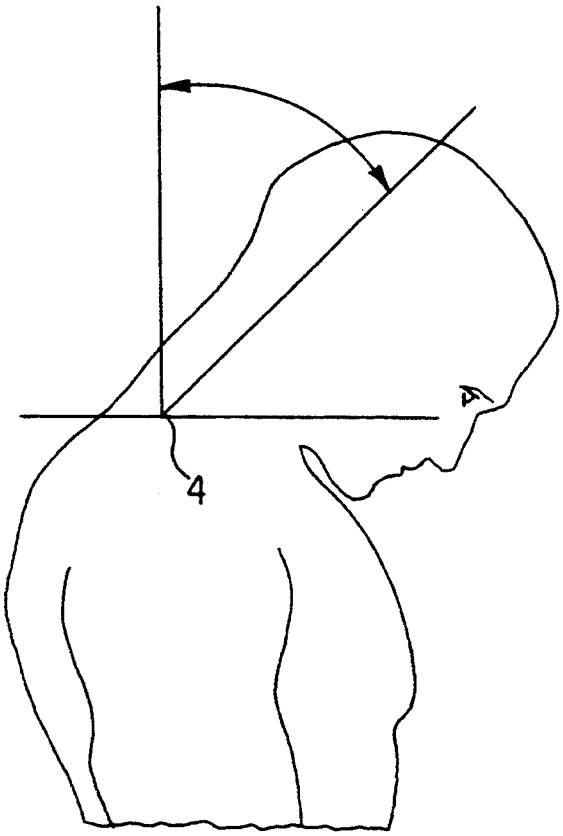
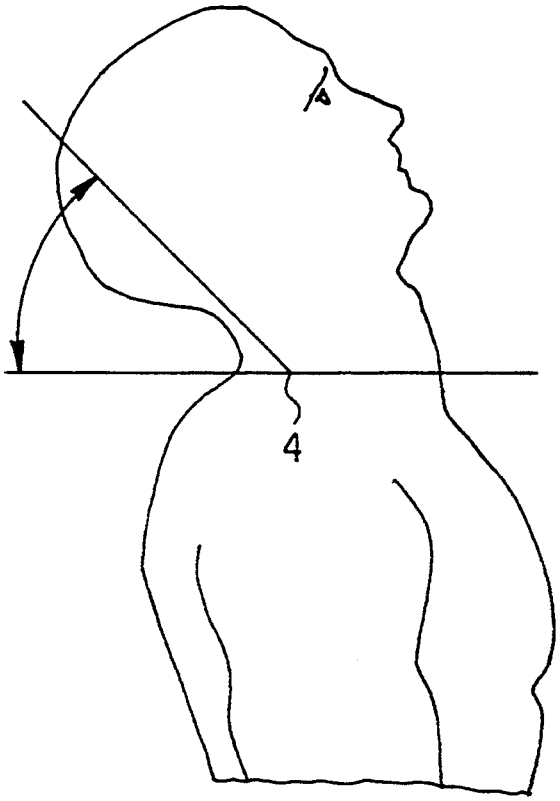
FIG. 1C

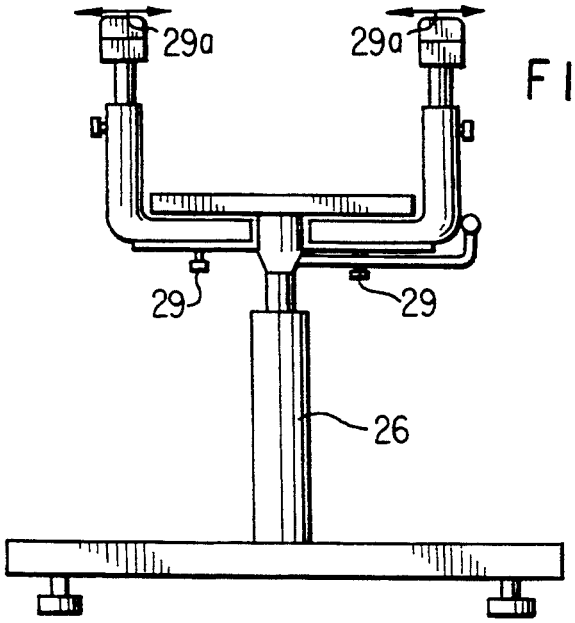
FIG. 3B
FIG. 4
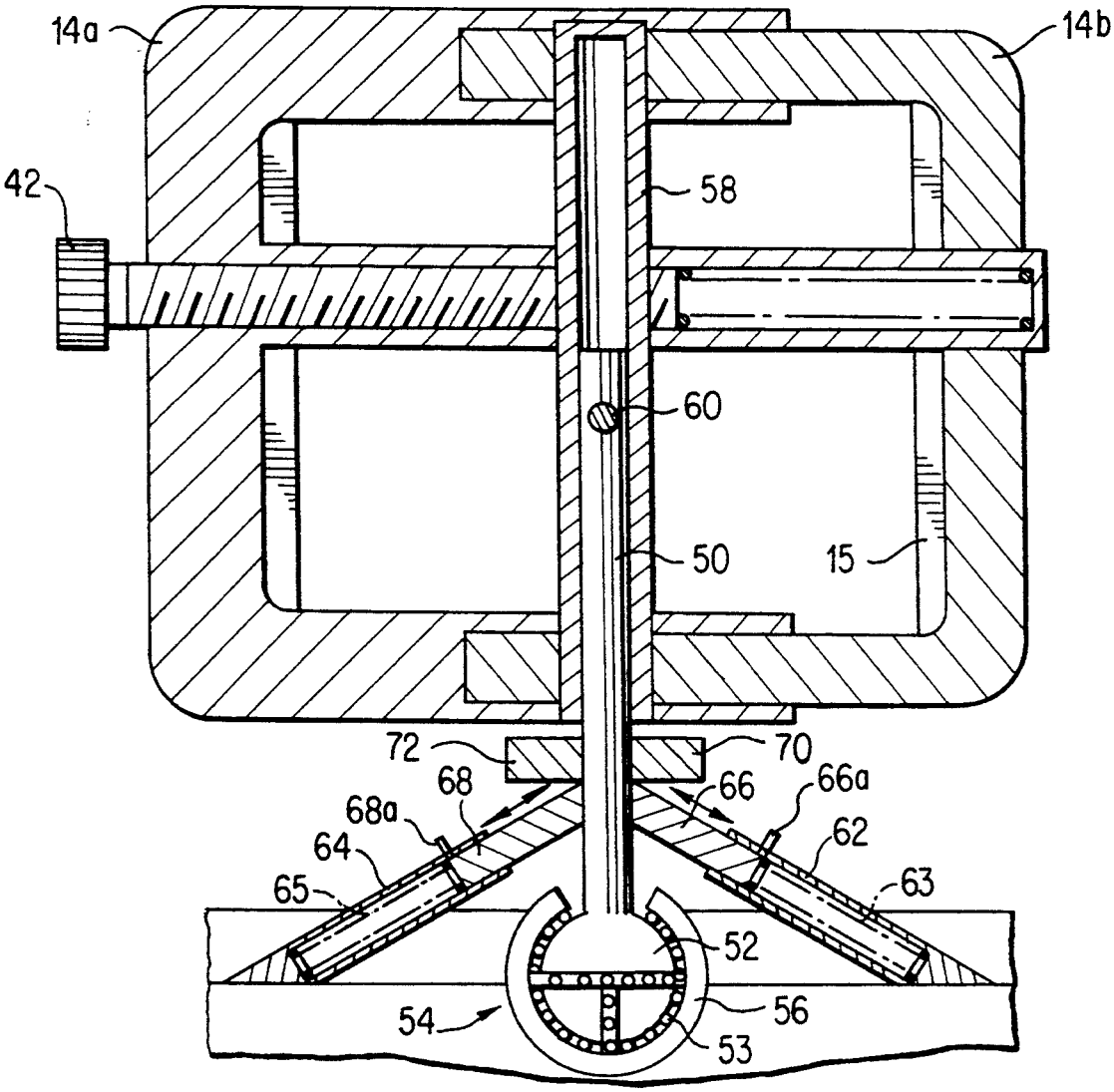

HEAD, NECK, AND SHOULDER EXERCISE MACHINE

BACKGROUND OF THE INVENTION

1. Field of the Invention

The invention relates to exercise machines which can be utilized for therapeutic reasons, or simply to improve the conditioning of the user. In particular, the present invention provides an improved head, neck and shoulder exercise machine which provides muscle conditioning for all normal head/neck movements.

2. Discussion of Background

Often, it is desirable to improve the strength and/or conditioning of muscles associated with movement of the human head, neck and shoulders. Conditioning these muscles can be particularly important in avoiding injuries in both professional and weekend athletes. Effective exercise also provides increased endurance, strength and range of motion. In addition, exercise is an important component in recovering from injuries which can result from participation in athletics, or from automobile accidents. Recently, conditioning of head, neck and shoulder muscles has been increasingly recognized as important in improving posture, relieving stress, and in reducing or alleviating head and neck pain including headaches which can result from poorly conditioned or atrophied shoulder and neck muscles. Exercise and conditioning of head, neck and shoulder muscles can alleviate or subside numerous conditions including pain, spasm, contractures, myofacial trigger points, swelling, abnormal tone or abnormal sensations. Head, neck and shoulder exercise can also be beneficial therapy in improving or correcting dizziness, blurred vision, loss of balance and vasomotor phenomenon.

Unlike many other structural/muscle groups of the human body, the head and neck can move in multiple different directions, and cannot be conveniently exercised with conventional free weights or weight machines. Head and neck movement is accomplished by a number of muscles or muscle groups cooperating primarily with the cervical vertebrae up to the first thoracic vertebrae. Some of the muscles associated with head and neck movement include the trapezius muscle, the sternocleidomastoid muscle, obliqus and rectus group, splenius capitis, splenius cervicis, the posterior cervical muscles, suboccipital, as well as the levator scapulae and scalene muscles. There are three basic movements of the head and neck including: (1) rotation in which the head rotates or turns from side to side; (2) forward and backward flexure and extension in which the head moves forward (e.g. to look downward) or backward (to look upward); and (3) lateral flexure in which the head moves laterally such that the person's ear is moving toward their shoulder.

Although the importance in exercising muscles in the neck region has been recognized, a satisfactory exercise device has not been available. Although a number of neck/shoulder machines are available, they suffer from a number of shortcomings. For example, many machines do not provide for proper isolation of the head, neck and shoulder movements, and do not provide for proper stabilizing and fixing of the torso or other portions of the body of the user. In addition, if the user is not properly positioned in the apparatus, abnormal movement can result, and pain or injury can result. In accordance with one shortcoming of conventionally available exercise machines, I have recognized a particularly widespread deficiency in that the exercise machines do not simulate the true movement of the human head and neck. This primarily results from the fact that conventional machines do not provide a joint which is aligned with the natural axis and movement of the cervical spine.

Accordingly, an exercise machine is desired which can improve the conditioning of muscles associated with movement of a person's head and neck. Such a machine should be capable of movement with a user's head and neck, and should be capable of movement in all directions for which a head is movable. In addition, the machine should provide resistance in opposition to neck movement of the user, thereby improving the strength of the muscles associated with head and neck movement. Most desirably, the machine should be able to simulate the natural movement of the human head and neck, and should include a joint arrangement which is substantially aligned with or synchronous with a person's neck when they are positioned in the machine, with movement of the machine about the joint simulating all normal types of movement of the human head and neck.

SUMMARY OF THE INVENTION

Accordingly, it is an object of the present invention to provide a therapeutic and/or exercise apparatus for conditioning muscles associated with head and neck movement.

It is another object of the present invention to provide a head, neck and shoulder exercise machine which is movable in all directions in which a human neck is movable.

It is a further object to provide a machine which can increase strength, endurance and range of motion of head, neck and shoulder muscles and the cervical spine, and which can also be utilized for treatment of a number of maladies as a part of multimodality treatment.

It is another object of the present invention to provide an exercise machine which can be used for measuring strength and flexibility/range of motion of head and neck movement, thereby assisting in assessing injuries as well as measuring progress in recovering from injuries.

It is a further object of the present invention to provide an exercise machine which is movable in flexure, extension, rotation, and lateral flexure directions of a user's neck, while providing resistance to such movement, thereby providing for therapy and/or conditioning of muscles associated with head and neck movement.

It is a still further object of the present invention to provide a head, neck and shoulder machine having a single joint which connects a head frame and a main frame, with the single joint providing freedom of movement in all directions for which a head is movable, such that when a person's head is received by a head frame of the machine, the single joint can be utilized for conditioning muscles associated with head, neck and shoulder movement.

These and other objects and advantages are attained in accordance with the present invention which provides a machine or apparatus for conditioning muscles associated with head, neck and shoulder movement. In a preferred embodiment, a head frame is provided for receiving the head of a person, with the person seated upon a main frame of the apparatus. The head frame is connected to the main frame utilizing a ball joint, such that a person's head received in the head frame is movable about three axes of movement, thereby allowing for flexure, extension, lateral bending and rotational movement. In addition, force or resistance applicators are provided, for example springs, in order to resist movement of the head frame, such that movement of the person's head is in opposition to the resistance members.

In accordance with a significant aspect of the present invention, the joint mirrors the movement of the human neck, at least over the ranges of normal neck movement. This movement is provided by utilizing a ball joint which can be positioned with respect to the user such that the ball joint is aligned with, or at least closely adjacent to all of the natural axes of movement of the human neck. Preferably, the frame of the device will stabilize and fix the remaining portions of the human body, particularly the torso, such that the head and neck movements can be isolated. However, since the movement of the machine about the joint directly corresponds to the physiological range of movement of the head and neck, injuries resulting from overextension and/or unnatural movement are avoided.

The present invention provides a joint which simulates movement of the head and neck, by drawing upon the realization that head and neck movements can be basically characterized as involving three types of movements which involve movement about three respective axes, and that the axes of movement intersect at or at least in the region of the $C_5$–$C_7$ cervical vertebrae. By providing a joint which is movable about all three axes and allowing for positioning of the joint adjacent the $C_5$–$C_7$ region of the user, the head, neck and shoulder machine of the present invention provides for movement which most nearly simulates the natural movement of the human head and neck. Although the present invention is particularly advantageous in exercising head, neck and shoulder muscles, it is to be understood that various aspects are also applicable to exercise apparatuses designed for other muscles as well.

BRIEF DESCRIPTION OF THE DRAWINGS

A more complete appreciation of the present invention and many of the attendant advantages thereof will be readily apparent with reference to the following detailed description, particularly when considered in conjunction with the drawings in which:

FIGS. 1A–E illustrate movements of the human head and neck;

FIG. 4 depicts the relationship between the head frame and ball joint of the head, neck and shoulder machine of the present invention;

DESCRIPTION OF THE PREFERRED EMBODIMENTS

Referring briefly to FIG. 1, the basic movements of a head and neck are shown. Although the present invention is directed towards muscles associated with head and neck movement, the machine is referred to as a head, neck and shoulder machine, since many muscles associated with head movement are also associated with shoulder movement. For example, the trapezius muscle, which is utilized for lateral movement of the head, also assists in movement of the shoulders, for example in a shrugging movement of the shoulders. As shown in FIG. 1A, a first basic movement of the head is lateral movement, or side to side movement, in which the ear moves toward the shoulder. As shown in FIG. 1A, a typical range of movement in sideward bending or lateral flexion is 40°–45° from vertical in each of the sideward directions as represented by arrows A. As should be readily apparent from FIG. 1, in lateral flexion or sideward bending, the head moves in an arcuate path which approximates pivotal movement about an axis 2. This axis corresponds substantially to the location of the $C_5$ and $C_7$ vertebrae.

FIGS. 1B–C illustrate another basic movement of the head, which substantially involves movement about another axis 4 which extends in a direction perpendicular to the axis 2 referred to in FIG. 1A. The movement represented in FIGS. 1B–C relates to flexion (FIG. 1B) and extension (FIG. 1C) in which the head is moved forward and rearward. The range for forward and rearward movement is approximately 45° in each direction. As with the lateral movement, the forward/rearward movement can also be approximated as movement about an axis which extends through the $C_5$–$C_7$ region.

Figure 1E:
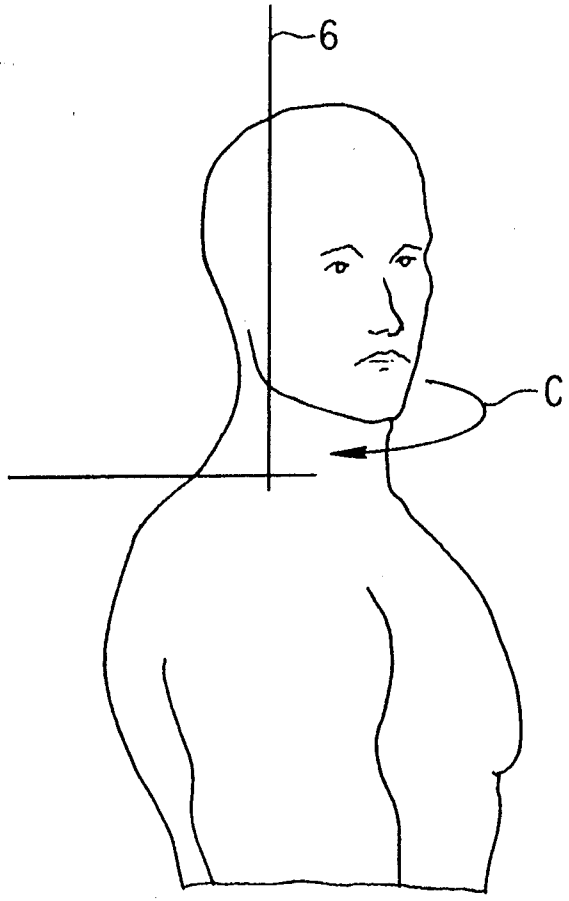
Figure 1D:
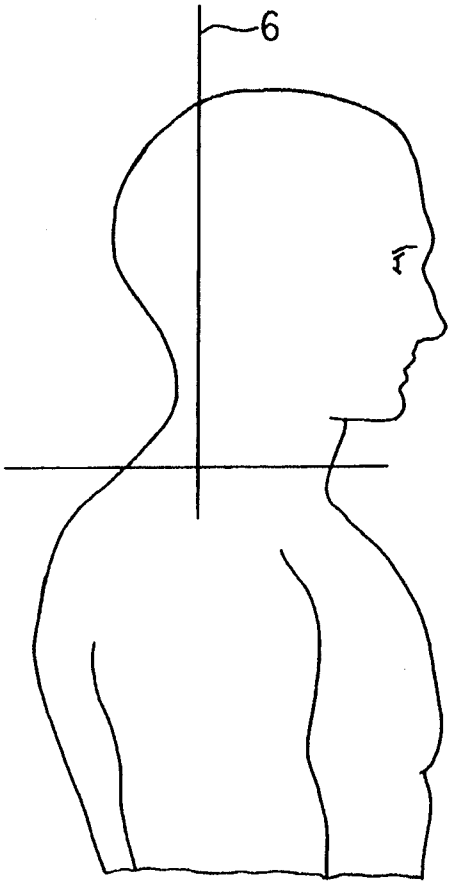

FIGS. 1D–E show a third basic movement of the head and neck, which involves rotation of the head. As shown in FIG. 1C, this movement also involves pivotal or rotational movement of the head about an axis 6. As should be readily apparent, this axis 6 extends in a direction which is perpendicular to both of the axes 2, 4 associated with sideward bending and forward-rearward flexion/extension. As with the axes 2, 4, the axis 6 also extends through the $C_5$–$C_7$ region. Sideward rotation is typically within a range of 80° from front center as shown at C.

In accordance with my invention, I have recognized that a more desirable exercise/conditioning machine can be provided if the machine includes a joint which approximates or simulates the movement of a human head and neck with respect to the cervical spine. Thus, by providing a joint which can be positioned adjacent the $C_5$–$C_7$ region or $C_5$–$T_1$ region of a person, and which is movable in all directions for which a human head is movable with respect to the cervical spine, the exercise machine provides movement which corresponds to the natural movements of the human head and neck.

Figure 2:
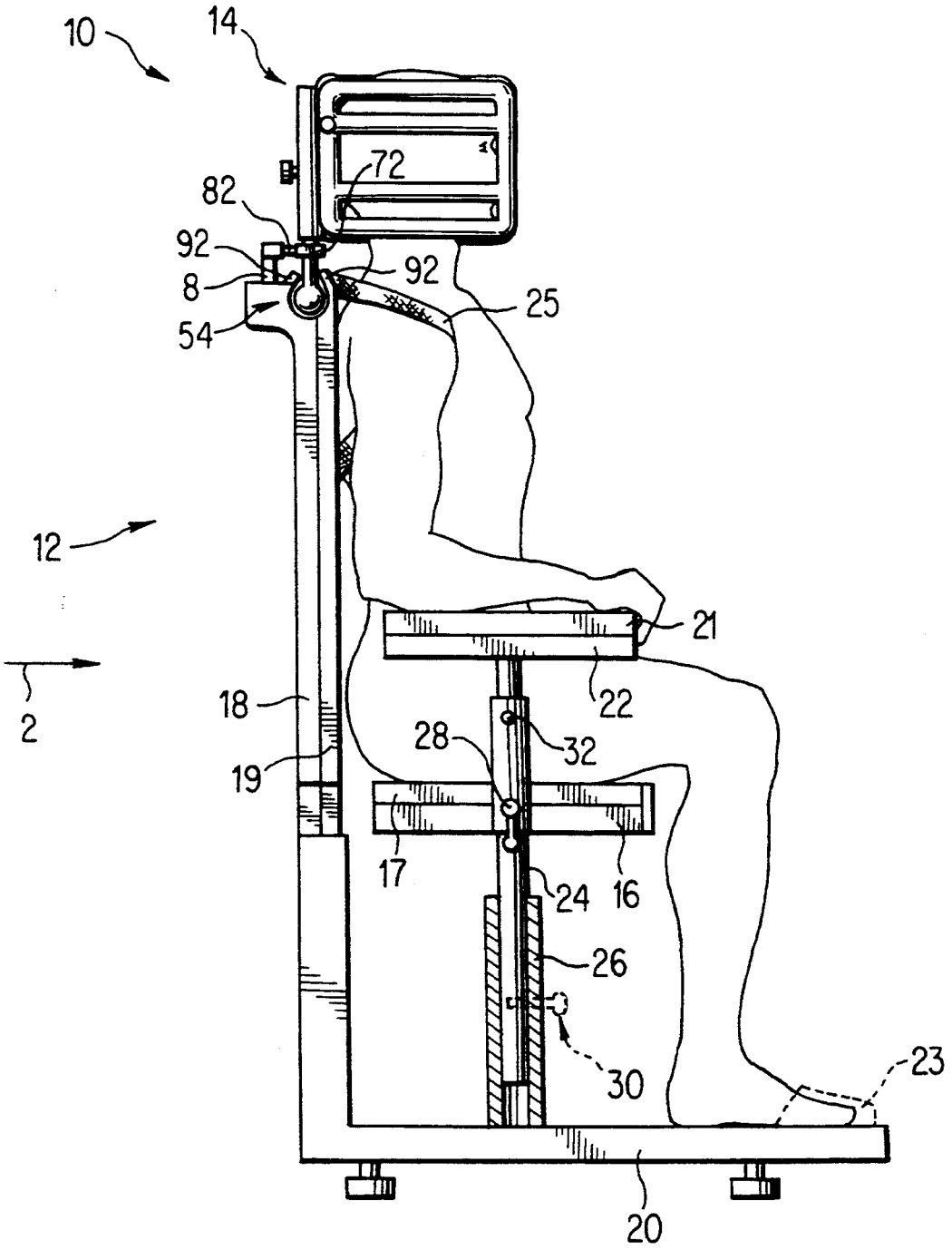
FIG. 2 is a side view of a head, neck and shoulder machine in accordance with one embodiment of the present invention.

Referring now to FIG. 2, a head, neck and shoulder exercise machine in accordance with the present invention will be described. In accordance with one aspect of the present invention, I have recognized the advantageous use of a joint which can simulate the movement of a person's head and neck, and further, when resistance is applied to resist movement about this joint, a person utilizing the head, neck and shoulder machine can condition the associated muscles by utilizing the head, neck and shoulder muscles to provide movement about the joint of the machine in opposition to the force applicators (or without opposition if it is desirable to use the machine solely to measure range of motion). In a preferred embodiment, these objectives are realized by providing a ball joint which connects a head frame and a main frame of the machine, with the ball joint preferably positioned such that it is aligned with or at least closely adjacent the axes of rotation of the cervical spine. Movement in the cervical spine occurs from the $C_5$ vertebrae to the cervico thoracic junction, with the cervico thoracic junction substantially fixed with regard to the three types of movement discussed hereinearlier (although there is some slight movement at the cervico thoracic junction, the cervico thoracic junction can be approximated as a fixed point about which the cervical spine rotates during the various movements of the head and neck). Accordingly, in accordance with one aspect of my invention, I have recognized the superior results achieved by providing a ball joint at a location which is aligned with the cervico thoracic junction, and which can be positioned closely adjacent to the cervico thoracic junction of the person utilizing the machine.

As shown in FIG. 2, the machine 10 includes a main frame indicated generally at 12, with a head frame indicated generally at 14. The main frame 12 includes a chair-like arrangement including a seat 16 and back support 18, suitably disposed upon a platform or other support 20 which provides appropriate overall stability of the machine. Arm rests 22 are also provided for assisting positioning of the person utilizing the machine, as well as ensuring the comfort of the user. The arm rests also assist in ensuring the person is immobilized, except for the head/neck movements. Each of the seat, back support and arm rests are provided with padding 17, 19, 21 for comfort.

In order to accommodate persons of various sizes, the seat 16 and arm rests 22 are vertically and horizontally adjustable. As shown in FIG. 2, this can be accomplished by utilizing a seat support rod 24 which is received telescopically in a tubular member 26 extending upwardly from the platform or base 20. The bar or rod 24 is movable within the tube 26, and the movement can be controlled, for example by a lever 28 which is readily accessible to the person seated in the machine. The lever 28 can control a hydraulic device for changing the vertical position of the seat 16, or could operate similar to an automobile jack in changing the vertical position of the seat 16. Alternatively, a more manual adjustment can be provided with a pin maintaining the relationship between the bar 24 and tube 26. For example, as shown in broken line at 30, a pin can extend through the tube 26 and into the bar 24, with the pin maintaining the relationship of the bar 24 with respect to the tube 26. When it is desired to adjust the seat 16, the pin 30 can be removed, with the pin re-inserted after the relationship between the bar 24 and tube 26 is adjusted as should be readily understood by those skilled in the art.

The arm rest 22 can be movable with the seat adjustment, and also may include a separate adjustment. For example, as shown at 32, an adjustment screw or pin can be utilized which can be removed to allow adjustment of the arm rest 22, with the pin 32 re-inserted after the correct adjustment has been made.

The main frame, including the seat and arm rests allows the user to be immobilized, such that the head, neck, shoulder exercises can be performed properly while the remainder of the body is stationary. To further assist in immobilization of the body, cups or straps can be provided for receiving the feet as indicated at 23. In addition, one or more straps can be connected to the frame as indicated at 25 to preferably extend across both shoulders of the user, thereby immobilizing the torso. Fixing the position of the torso is particularly important in maintaining the proper positioning of the user and isolating the head, neck and shoulder movements.

The head frame 14 receives the head of a person desiring therapy and/or conditioning, with the head frame 14 also including suitable padding and adjustment features to ensure comfort and proper positioning of various head sizes as will be discussed in further detail hereinafter. Significantly, a single joint 54 is utilized for interconnecting the head frame 14 and the main frame 12. In accordance with a significant aspect of the present invention, I have recognized that a ball joint 54 can provide a relatively simple, yet most appropriate simulation of all of the basic types of movement of a human head and neck, which movements were discussed earlier with reference to FIGS. 1A–E. Thus, with a person seated in the machine 10, all of the muscles associated with head and neck movement can be conditioned and exercised with the joint enabling all movements associated with the natural movements of the human head/neck.

Figure 3A:
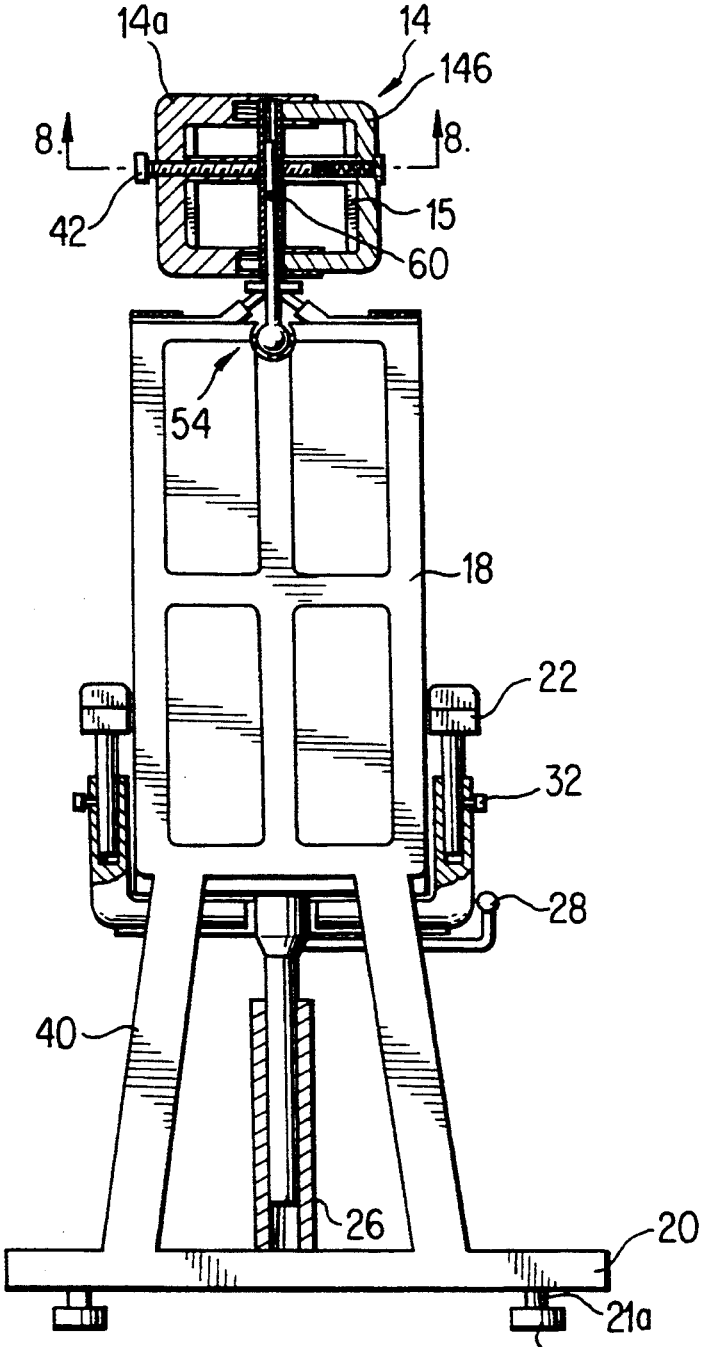
FIGS. 3A and B is a rear-view of the head, neck and shoulder machine of FIG. 2.
Figure 8:
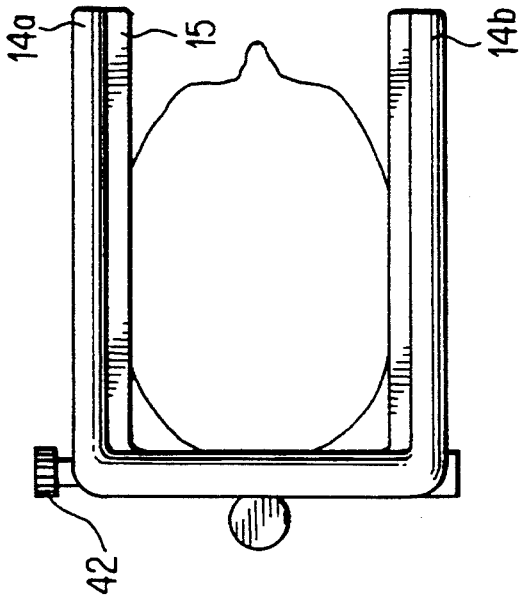
FIG. 8 shows a top cross-sectional view of a portion of the head frame, illustrating adjustment of the head frame to securely accommodate heads of various sizes.

FIG. 3A shows a view from behind the machine of FIG. 2 (i.e., as seen from the direction of arrow 2 in FIG. 2). As shown, the overall frame construction can include a tubular steel frame 40, or other frame constructions which provide for a stable, long-lasting machine. As discussed earlier, the head frame includes adjustments which accommodate various head sizes and neck lengths and which also can assist in entering and exiting of the head from the frame 14. In the exemplary arrangement shown in FIG. 3A, the head frame 14 includes two half-frame portions **14*a*, 14*b* which are in a sliding or telescoping relationship with one another. A screw 42, or other suitable adjusting device, is provided for adjusting the relationship between the frame halves 14*a*, 14*b*. To ensure user comfort, padding 15 is provided at the interior of the head frame, preferably at any location which a person's head would contact the head frame 14. FIG. 8 provides a further illustration of the adjustment of the head frame width along section VIII—VIII of FIG. 3. Of course, additional adjustments may be provided for other locations or dimensions of the head frame. The base 20 can also be provided with legs 21 with optional adjustable portions 21a which may be, for example, threaded shafts, thereby allowing for stable positioning of the machine 10** upon a floor, even if the floor is not completely flat or planar.

A suitable adjustment device 60 is also provided for adjusting the vertical height of the frame 14 with respect to the joint 54. Thus, since the seated position of the person can be adjusted, as well as the head position, a person can be located in the device with the joint 54 at a desired position along the cervical spine as will be discussed in further detail hereinafter.

FIG. 3B shows portions of the seat/armrest of FIG. 3A with parts omitted for illustrative purposes. As shown in FIG. 3B, a suitable adjustment, for example pins or screws 29, can be provided for a widthwise adjustment of the arms in the direction indicated by arrows 29a. This adjustment also allows for the accommodation of users of various sizes.

Referring now to FIG. 4, additional details of the head frame, as well as the ball and socket joint interposed between the head frame and the main frame will be described. As shown in FIG. 4, a main post or connecting rod 50 is provided which connects a rearward portion of the frame 14 to a ball 52 of a ball and socket joint or ball joint 54. The rod 50 is aligned with the cervical spine such that the head frame 14 is movable with the natural movements of a human head. The ball or sphere 52 is received in a socket 56 which is connected to the main frame. To provide smooth, long-lasting movement, ball bearings 53 may be interposed between the ball 52 and socket 56. Other suitable means may be provided such that the ball 52 is properly journaled within the socket 56, and if tolerances are sufficiently small, the ball 52 may be received in the socket 56 with only a lubricant interposed therebetween.

Still referring to FIG. 4, it should be readily apparent that the rod 50 is telescopically received by a tubular member 58 of the head frame 14, with an adjusting pin represented at 60 allowing for adjustment or positioning of the rod 50 within tubular member 58. Thus, the distance between the ball joint 54 and the head frame 14 can be adjusted. This adjustment, together with the adjustment of the seat 16, allows the user to be properly positioned with respect to the ball joint 54. In accordance with one aspect of my invention, I have recognized that the use of a ball joint which can be properly positioned with respect to the user, provides for a head, neck and shoulder machine in which the movement of the head frame simulates movement of the head and neck. As a result, the user can perform exercises corresponding to all of the basic movements of the human head and neck region.

To provide resistance for such exercises, resistance applicators or force applicators can be provided. For example, as shown in FIG. 4, a pair of cylinders 62, 64 can be provided for imparting resistance to lateral movement or sideward bending. Posts 66, 68 can extend from the respective cylinders 62, 64, with the posts 66, 68 movable in and out of the cylinders 62, 64 as represented by the double arrows. When the user is seated upon the main frame with their head positioned in the head frame 14, the lateral or side bending exercises can thus be performed. When the user moves their head rightwardly, such that their right ear is moving toward their right shoulder, the rod 66 will move into the cylinder 62 in opposition to a spring 63 contained within the cylinder. Similarly, when the user moves such that their left ear is moving toward their left shoulder, the rod 68 moves into the cylinder 64 in opposition to the spring 65. Thus, the exercise machine provides for conditioning of the sideward bending or lateral flexion movement.

As should be readily apparent, hydraulic cylinders, electromagnetically-controlled cylinders, or other force/resistance applicators could be utilized in lieu of the spring cylinder arrangement shown in FIG. 4. Such resistance or force applicators can include electronically and/or computer controlled systems similar to those utilized in a wide variety of exercise machines, and may provide a digital or graphic display indicating range of motion and/or force exerted, possibly even a cumulative total of exercises performed, and/or perform further computer analysis providing feedback to the user.

Further, with regard to range of motion, often it is desirable to obtain information regarding a user's range of motion separate from, or in addition to, information regarding the user's strength. Such information can be useful in determining the extent of an injury or condition, as well in measuring progress, or to ensure that a therapeutic program is adhered to thereby avoiding overexertion or underperformance. In a simple arrangement, the posts 66, 68 can include flags or pins 66a, 68a which extend through slots in the cylinders 62, 64, and markings can be provided on the cylinders 62, 64 in order to readily measure the range of motion. Alternatively, a scale, similar to that provided on a protractor can be associated with the frame in order to measure angular movements of the post 50, thereby providing an angular measurement of the range of movement of the head/neck. Such range of motion measurements can be provided while the person is moving their head and neck without opposition by the force applicators, or with force applicators utilized which merely provide a nominal returning force to return the head frame to a rest position. As an alternative to the visual range of motion assessment, position sensors could be utilized, with range of motion information displayed digitally or graphically. A computer for receiving input data from the position sensors and analyzing the input data for providing output to the user could also be utilized. Thus, in addition to the improved capabilities of the present invention in conditioning and/or strengthening, the present invention is also most convenient in providing range of motion measurements, since the ball joint is positioned at the cervico thoracic junction, which is substantially stationary with regard to head and neck movement. Therefore, the ball joint simulates the cervico thoracic junction, and movement of the head frame about the ball joint can be utilized in obtaining information regarding range of movement of the head and neck of the person using the machine.

The springs/resistance devices for other movements of the head and neck are omitted from FIG. 4 for illustrative purposes. However, as will be readily apparent, the rod 50 includes a pair of extensions or plates 70, 72 which are utilized for conditioning the rotational movement of the head. As should be readily apparent, the head frame 14 and joint 54 arrangement readily allows for rotational movement of a person's head disposed within the head frame 14. Force applicators or resistance applicators engage the respective plates 70, 72 during this rotational movement, thereby providing resistance to the rotational movement for the rotational exercise. Cylinders 92 are also provided for resistance of forward/rearward movement as shown in FIG. 1.

Figure 5:
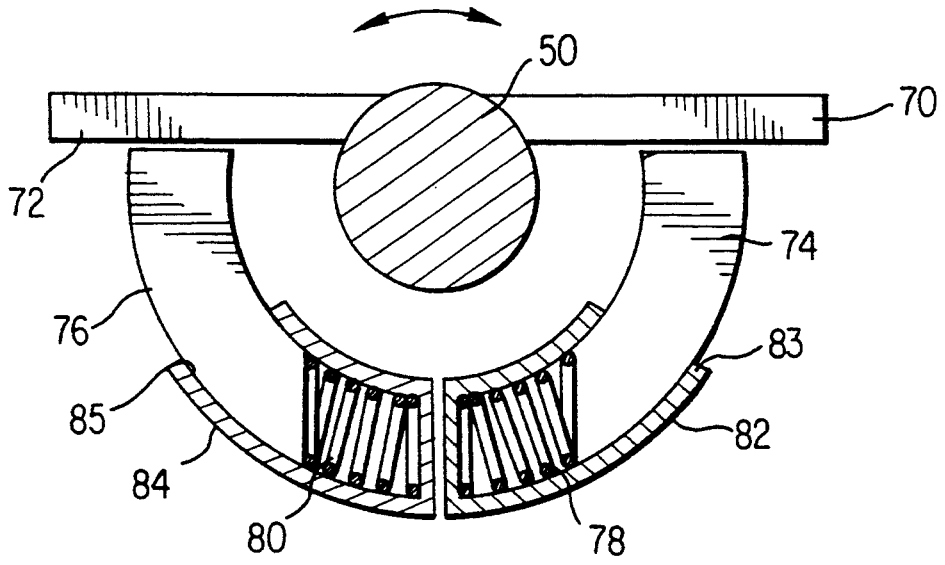
FIG. 5 illustrates the spring arrangement utilized for providing resistance to rotational movement in the head, neck and shoulder machine of the present invention.

FIG. 5 shows a plan view of the resistance arrangement for head rotation exercises, with other elements of the machine omitted for improved clarity. When a person is performing the rotational exercise, the rod 50 will rotate as indicated by the double headed arrow, with this rotation possible by the ball joint interface between the head frame 14 and the main frame 12. Although the rod 50 is shown having a circular cross-section, it should be readily understood that a square or polygonal cross-section may also be utilized if desired. For example, a more rectangular cross-section may be desirable in providing a better interface of the rod 50 with the rods 66, 68 (FIG. 4) utilized for the lateral movement. Of course, even a rod 50 having a circular cross-section can be provided with flat portions at locations which interface with the rods 66, 68 (as well as the rods associated with the forward and backward movement as will be discussed hereinafter). As shown in FIG. 1, the rotational resistance cylinders can be mounted on a post 81. The post 81 can be movable, for example to allow for the flexion/extension exercises via cylinders 92 without resistance by the rotational resistance cylinders. Alternatively, the post 81 could be designed as stationary, with the rotational cylinders also resisting flexion and for extension movements.

As should also be readily apparent from FIG. 5, as a person performs rotational movement, the plates 72, 70 will engage rod members 74, 76 to move the rod members 74, 76 in opposition to springs 78, 80 within cylinders 82, 84. Preferably, the cylinders 82, 84 will be sized and shaped with respect to the rods 74, 76, such that smooth resistance is provided to the arcuate movement of plates 70, 72 as the user rotates their head, thereby pivoting rod 50. The cylinders 82, 84 may include end plates 83, 85 for guidably receiving the arcuate rods 74, 76. As should be readily understood, when a user is rotating their head from a front-center position leftward, the plate 72 will engage the arcuate rod 76, such that resistance to the rotational movement of the head is provided. Similarly, when the user is rotating their head rightwardly, the plate 70 engages rod 74, such that rotational movement is allowed under the resistance of the spring 78. As with the lateral or side bending resistance devices, a number of alternatives may be provided to the cylinders utilized for resisting rotational movement. In addition, suitable indicators may be provided for direct visual measurement of the range of rotational movement, or with sensors provided which yield an electronically generated digital or graphic display.

The forward and rearward flexion and extension are provided similar to the lateral flexion shown in FIG. 4, and therefore complete details thereof are not deemed necessary. As shown in FIG. 2, corresponding force applicators or resistance members can be provided in the form of rod and cylinder arrangements. Thus, for the forward flexion, a rod/cylinder 92 can be provided, with a corresponding rod/cylinder arrangement 92 provided for rearward extension. As with the lateral and rotational movements, alternate resistance applicators may be utilized, and suitable means for measuring the range of motion may also be provided for the forward and rearward movement.

Figure 6:
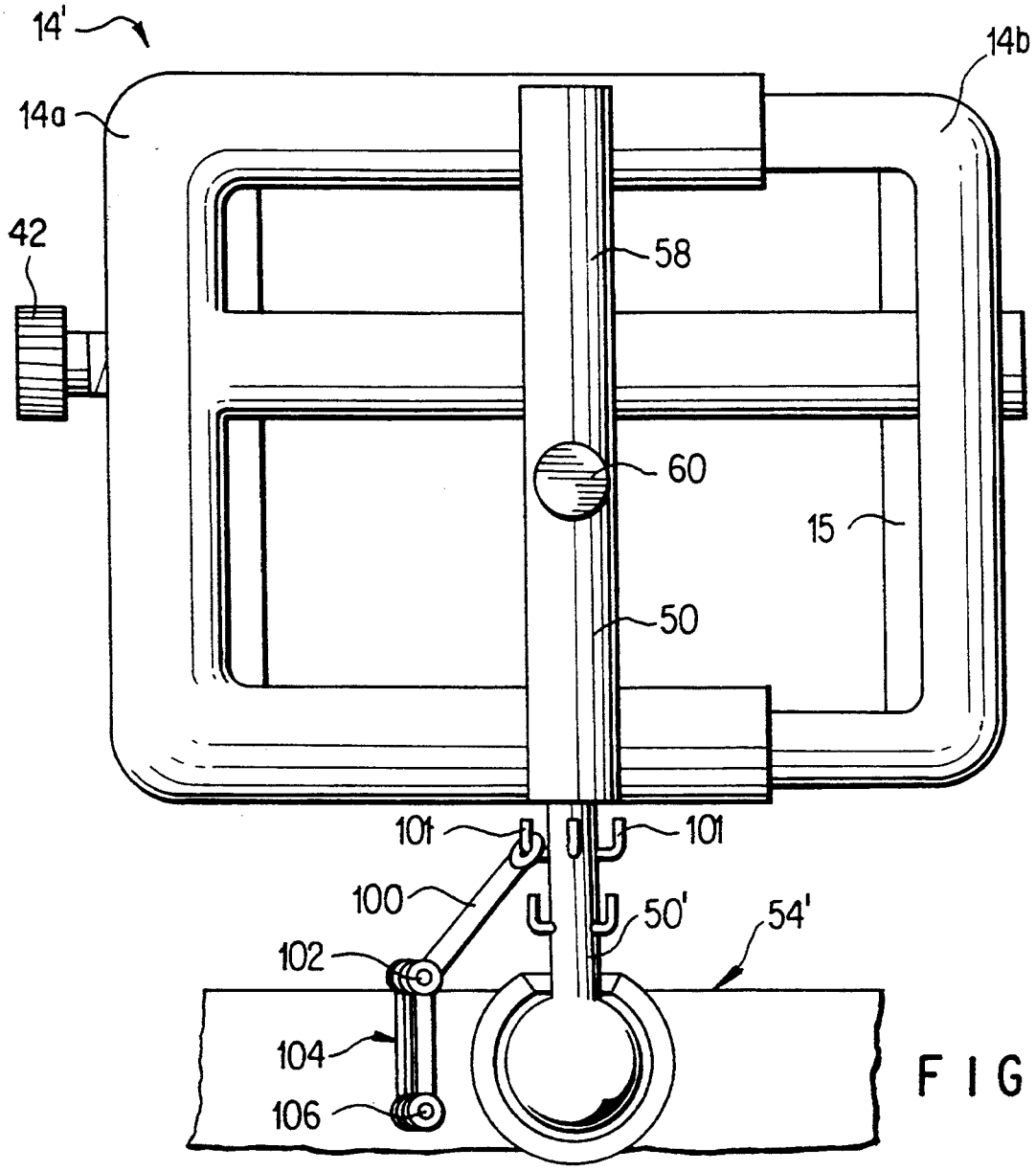
FIG. 6 shows an alternate embodiment of the head, neck and shoulder machine of the present invention in which elastic bands are utilized for providing resistance to movement.

Referring now to FIG. 6, an alternate embodiment of the present invention is shown. The details of the head frame and main frame can be similar to that of the FIG. 2 embodiment, and therefore will not be described. As shown in FIG. 6, in lieu of the spring/cylinder arrangement, elastic bands may also be provided. Similar type bands are utilized in a variety of exercise machines currently in use. As shown in FIG. 6, the rod 50' includes a plurality of hooks 101 disposed thereon for attachment of a plurality of bands, such that as the user moves their head disposed in the frame 14' about joint 54', the elastic bands resist the movement, thereby providing for strengthening and conditioning. Only one band 100 is shown disposed upon the hooks, such that the disposition of the hooks upon the rod 50' is readily apparent. However, it is to be understood that one or more bands are to be provided upon each of the hooks, for resisting the various movements of the head and neck. As shown in FIG. 6, one end of the band 100 can be attached to a hook 101, with the other end of the band 100 attached to a post or hook 102 fixed to the main frame. This post 102 can also serve to store a plurality of reserve bands 104, such that bands may be substituted or added, thereby providing for variation in the amount of resistance to the various movements. An additional post 106 can also be provided for holding the other end of the reserve bands 104. Since different amounts of forces may be associated with different movements, it can be desirable to provide the storage locations adjacent to the locations at which the bands are to utilized as shown in FIG. 6. However, a single storage location may also suffice. The band 100 shown in FIG. 6 is utilized for rightward lateral flexion, i.e., to resist movement of a person as their head moves such that their right ear is moving toward their right shoulder. Additional details of the elastic band embodiment will be discussed hereinafter with reference to FIG. 7B.

Figure 7A:
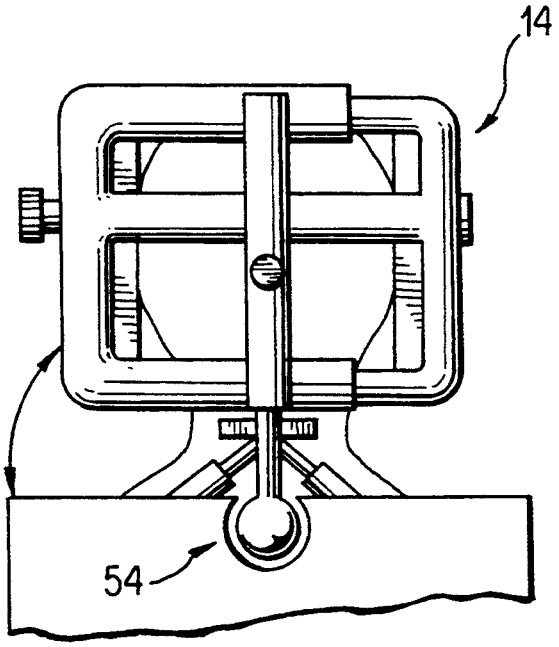
FIGS. 7A–C show the relationship of the person exercising and the joint which connects the head frame and main frame.
Figure 7B:
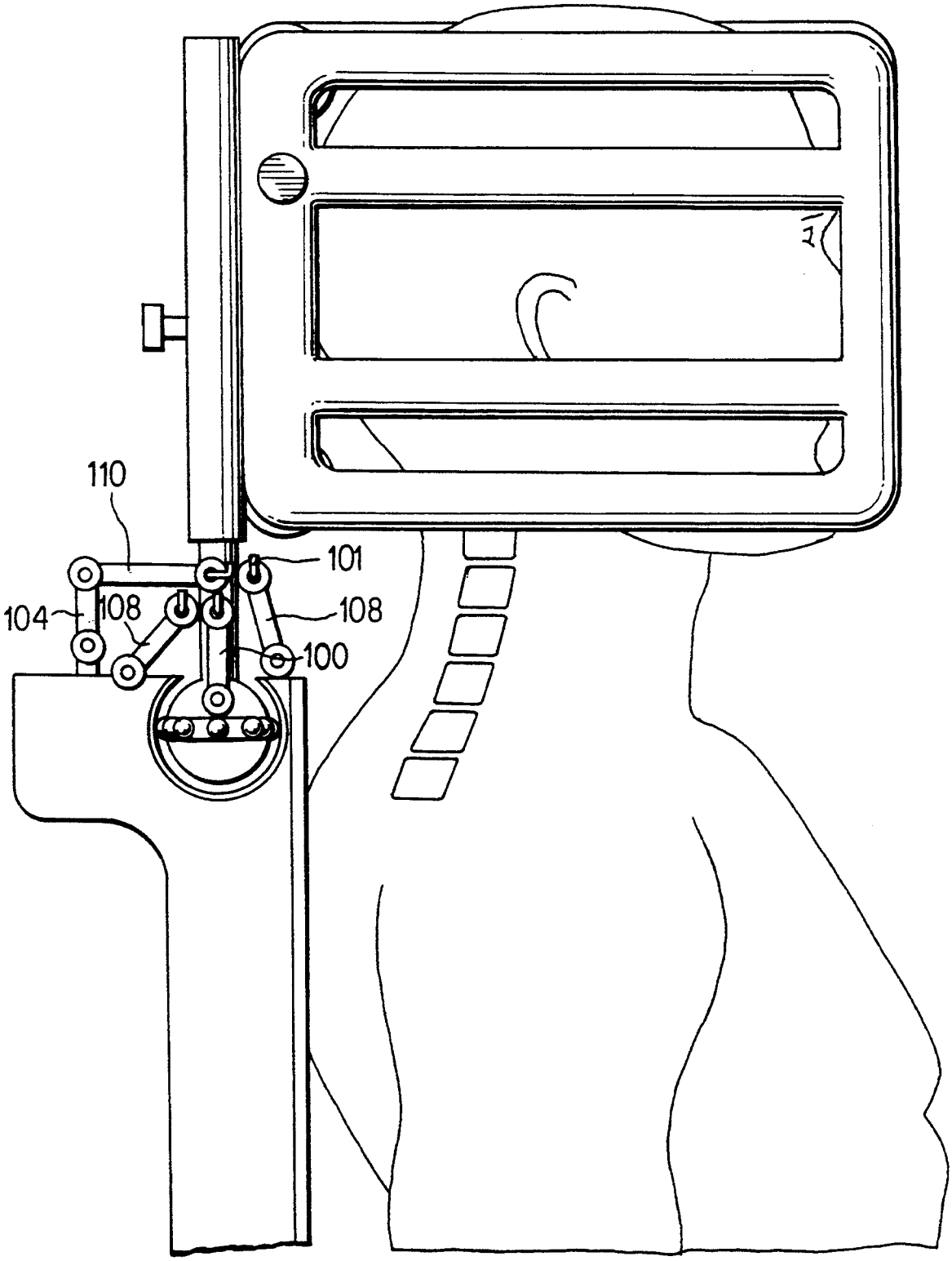
Figure 7C:
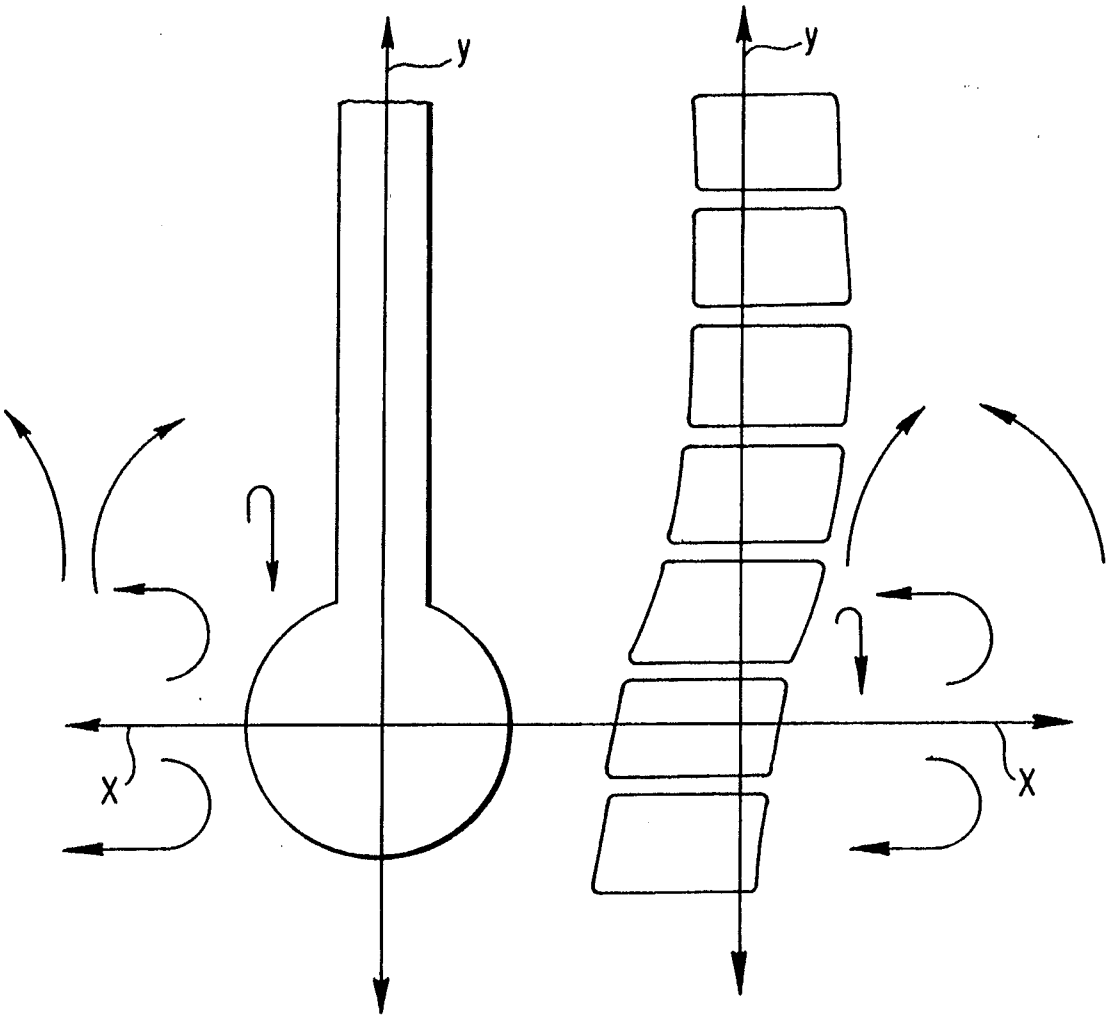

Referring briefly now to FIGS. 7A–C, as discussed earlier, the use of a ball joint 54 as an interface between the head frame 14 and the main frame 12, together with appropriate adjustment arrangements to allow the joint 54 to be provided at the proper location, enables movement of the head frame 14 substantially identical to the basic movements of the human head and neck. FIGS. 7A and 7B illustrate the proper positioning of the ball joint 54. As shown in FIG. 7A, the ball joint 54 can be positioned such that it is aligned with the cervical axis, with the combined height adjustment and seat adjustment allowing the ball joint 54 to be positioned at the cervico thoracic junction of the user, as also shown in the side-view of FIG. 7B. With the ball positioned at the cervico thoracic junction, or the region of $C_5$–$C_7$, and further with the ball substantially the same size as the combined $C_5$ and $C_7$ region, the head frame can duplicate all of the normal motions of the neck. As discussed earlier, and as illustrated in FIG. 7C, the ball joint substantially follows all of the basic movements about the $C_5$–$C_7$ region, with the ball joint aligned with the $C_5$–$C_7$ area as indicated by the double arrow X, with the axis also aligned with the vertical axis of the spine as indicated by arrows Y.

FIG. 7B also shows the mounting of various elastic bands in the embodiment discussed earlier in conjunction with FIG. 6. As shown in FIG. 7B, bands 100 are provided for lateral movement, with bands 108 provided for resisting forward and rearward movement, and bands 110 resisting rotational movement.

As mentioned earlier, various aspects of the present invention are also applicable to other exercise apparatuses. For example, a ball joint can be interposed between a stationary frame part and a moveable frame part for exercising upper or lower body extremities, with the ball joint simulating shoulder, hip or even finger movements.

Obviously, numerous modifications and variations of the present invention are possible in light of the above teachings. It is therefore to be understood that within the scope of the appended claims, the invention may be practiced otherwise than as specifically described herein.

I claim:

1. An exercise apparatus for exercising muscles associated with head, neck and shoulder movement comprising:

a main frame;

a head frame for receiving a head of a user;

a joint interposed between said main frame and said head frame such that said head frame is movable with respect to said main frame to provide movement of said head frame corresponding to lateral flexion movement in two directions, forward flexion, backward extension and rotation of a head disposed within said head frame;

a rod extending from said joint and connecting said head frame to said joint;

said apparatus further including resistance means mounted in a plurality of orientations between said rod and said main frame for providing resistance to movement of said head frame.

2. The exercise apparatus of claim 1, wherein said joint comprises a ball joint including a spherical member disposed within a socket.

3. The exercise apparatus of claim 2, wherein said socket is connected to said main frame and wherein said spherical member is connected to said rod.

4. The exercise apparatus of claim 2, wherein said main frame includes means for positioning a person such that said ball joint is adjacent to the spine when a person's head is received in the head frame.

5. The exercise apparatus of claim 4, wherein said main frame includes a seat for receiving a person in a seated position, and a height adjustment mechanism for adjusting the height of said seat.

6. The exercise apparatus of claim 5, further including a back support, and wherein said ball joint is mounted to an upper portion of said back support.

7. The exercise apparatus of claim 2, wherein said main frame includes means for positioning a person such that said ball joint is aligned with a person's $C_5$–$C_7$ vertebrae.

8. The exercise apparatus of claim 7, further including means for adjusting a distance between said ball joint and said head frame.

9. The exercise apparatus of claim 8, wherein said main frame includes a seat for receiving a person in a seated position, and a height adjustment mechanism for adjusting the vertical height of said seat.

10. The exercise apparatus of claim 8, further including a back support, and wherein said ball joint is mounted to an upper portion of said back support.

11. The exercise apparatus of claim 5, further including means for immobilizing a person seated in the main frame, thereby isolating the person's movement to movements associated with the head frame about the ball joint.

12. The exercise apparatus of claim 11, wherein said means for immobilizing includes at least one strap for immobilizing the person's torso.

13. The apparatus of claim 9, further including a pair of armrests and means for adjusting said armrests horizontally and vertically.

14. The apparatus of claim 11, wherein said means for immobilizing includes a pair of straps extending across a user's shoulders.

15. An apparatus for use in therapy and exercise including:

a main frame;

a head frame for receiving a head of a user;

a ball joint between said main frame and said head frame allowing relative movement of said head frame with respect to said main frame, wherein said joint is located at a vertical level below said head frame;

the apparatus further including a rod connecting said ball joint and said head frame, and wherein resistance means are provided in a plurality of orientations between said main frame and said rod, for providing resistance to movement of said head frame about said ball joint in a plurality of directions.

16. The apparatus of claim 15, further including adjustment means for positioning said joint with respect to the cervical spine of the user.

17. The apparatus of claim 16, wherein said adjustment means includes means for adjusting said joint such that said joint can be positioned adjacent the $C_5$–$C_7$ region of the user.

18. The apparatus of claim 15, further including means for holding the user in a seated position in which at least their torso is immobilized.

19. The apparatus of claim 15, further including means for measuring a range of motion of said head frame with respect to said main frame, thereby providing an indication of the user's range of head and neck movement.

20. An exercise apparatus for exercising muscles associated with head, neck and shoulder movement, comprising:

a main frame including a back support for supporting a person using the exercise apparatus;

a ball joint mounted at an upper portion of said back support;

a head frame for receiving a head of a person using said exercise apparatus;

a connector connecting said head frame to said ball joint; and a plurality of resistance devices mounted in a plurality of orientation between said connector and said upper portion of said back support thereby providing resistance to movement as a person using the device moves said head frame with respect to said main frame.

21. The exercise apparatus of claim 20, wherein said plurality of resistance devices include resistance means for resisting movement of said head frame corresponding to lateral flexion movement in two directions, forward flexion, backward extension and rotation of a head disposed within said head frame.

* * * * *

UNITED STATES PATENT AND TRADEMARK OFFICE

CERTIFICATE OF CORRECTION

PATENT NO. : 5,336,138

DATED : August 9, 1994

INVENTOR(S) : P. Singh Ajrawat

It is certified that error appears in the above-indentified patent and that said Letters Patent is hereby corrected as shown below:

On the title page, Item [75], the inventor's last name should read as follows:

--Ajrawat--

Signed and Sealed this

Twentieth Day of September, 1994

*Attest:*

*Attesting Officer*

Bruce Lehman

BRUCE LEHMAN

*Commissioner of Patents and Trademarks*